US009746797B2

(12) United States Patent
Goda et al.

(10) Patent No.: US 9,746,797 B2
(45) Date of Patent: Aug. 29, 2017

(54) IMAGE FORMING APPARATUS COMPRISING A BODY, A PHOTORECEPTOR UNIT, AND A DEVELOPING UNIT

(71) Applicant: KYOCERA Document Solutions Inc., Osaka-shi, Osaka (JP)

(72) Inventors: Mitsuhiro Goda, Osaka (JP); Susumu Hanano, Osaka (JP)

(73) Assignee: KYOCERA DOCUMENT SOLUTIONS INC., Osaka-Shi, Osaka (JP)

( * ) Notice: Subject to any disclaimer, the term of this patent is extended or adjusted under 35 U.S.C. 154(b) by 0 days.

(21) Appl. No.: 15/190,242

(22) Filed: Jun. 23, 2016

(65) Prior Publication Data

US 2016/0378018 A1 Dec. 29, 2016

(30) Foreign Application Priority Data

Jun. 26, 2015 (JP) ..... 2015-129226
Apr. 5, 2016 (JP) ..... 2016-075612

(51) Int. Cl.
*G03G 15/08* (2006.01)

(52) U.S. Cl.
CPC ..... *G03G 15/0808* (2013.01)

(58) Field of Classification Search
USPC ..... 399/107, 110, 111, 113, 252, 258, 262, 399/265, 279, 286
See application file for complete search history.

(56) References Cited

U.S. PATENT DOCUMENTS

| | | | | |
|---|---|---|---|---|
| 6,330,410 | B1 * | 12/2001 | Okabe | G03G 15/0813 399/111 |
| 7,190,921 | B2 * | 3/2007 | Ishii | G03G 21/1821 399/111 |
| 9,122,241 | B2 * | 9/2015 | Itabashi | G03G 21/1821 |
| 9,141,081 | B2 * | 9/2015 | Hayakawa | G03G 21/1619 |
| 2007/0048009 | A1 | 3/2007 | Izumi et al. | |
| 2014/0029979 | A1 | 1/2014 | Yamamoto | |

FOREIGN PATENT DOCUMENTS

| | | | |
|---|---|---|---|
| JP | 2004271674 | A | 9/2004 |
| JP | 2007094386 | A | 4/2007 |
| JP | 2008009295 | A | 1/2008 |
| JP | 2014026214 | A | 2/2014 |
| JP | 2014059586 | A | 4/2014 |

* cited by examiner

*Primary Examiner* — Hoan Tran

(57) ABSTRACT

An image forming apparatus includes a body, a photoreceptor unit, and a developing unit. The developing unit includes a first attaching/detaching lever that moves a developing sleeve from a first position to a second position by lifting the first attaching/detaching lever. The photoreceptor unit includes a second attaching/detaching lever that moves the developing sleeve from the first position to the second position by lifting the second attaching/detaching lever. The photoreceptor unit and the developing unit move the developing sleeve to the second position by lifting the first or second attaching/detaching lever so that the photoreceptor unit and the developing unit are individually detached from the body.

6 Claims, 16 Drawing Sheets

IMAGE FORMING APPARATUS COMPRISING A BODY, A PHOTORECEPTOR UNIT, AND A DEVELOPING UNIT

INCORPORATION BY REFERENCE

The disclosures of Japanese Patent Application No. 2015-129226 filed on Jun. 26, 2015 including the specifications, drawings, and abstracts and Japanese Patent Application No. 2016-75612 filed on Apr. 5, 2016 including the specifications, drawings, and abstracts are incorporated herein by reference in their entireties.

BACKGROUND

The present disclosure relates to an image forming apparatus.

In an image forming apparatus typified by a multifunctional peripheral, a photoreceptor included in an image forming part is irradiated with light based on image data so that an electrostatic latent image is formed on the photoreceptor. Then, charged toner is applied onto the electrostatic latent image to form a visible image, and the visible image is transferred onto a sheet of paper. Thereafter, the toner on the sheet is fixed onto the sheet with a fixing device included in the image forming apparatus. Subsequently, the sheet on which the toner has been fixed is discharged to the outside of the apparatus.

Techniques regarding an image forming apparatus including a photoreceptor unit and a developing unit have been known to date.

SUMMARY

An image forming apparatus according to the present disclosure includes a body, a photoreceptor unit, and a developing unit. The photoreceptor unit includes a photoreceptor having a surface on which an electrostatic latent image is to be formed. The photoreceptor unit is detachably mounted on the body. The developing unit is detachably mounted on the body and includes a developing sleeve that supplies a developer to the photoreceptor. The developing sleeve is movable to a first position at which the developing sleeve is allowed to supply the developer to the photoreceptor and a second position at which the photoreceptor and the developing sleeve are separated from each other to avoid contact between the photoreceptor and the developing sleeve. The developing unit includes a first attaching/detaching lever that moves the developing sleeve from the first position to the second position by lifting the first attaching/detaching lever. The photoreceptor unit includes a second attaching/detaching lever that moves the developing sleeve from the first position to the second position by lifting the second attaching/detaching lever. The photoreceptor unit and the developing unit move the developing sleeve to the second position by lifting the first attaching/detaching lever or the second attaching/detaching lever so that the photoreceptor unit and the developing unit are individually detached from the body.

DETAILED DESCRIPTION

Figure 1:
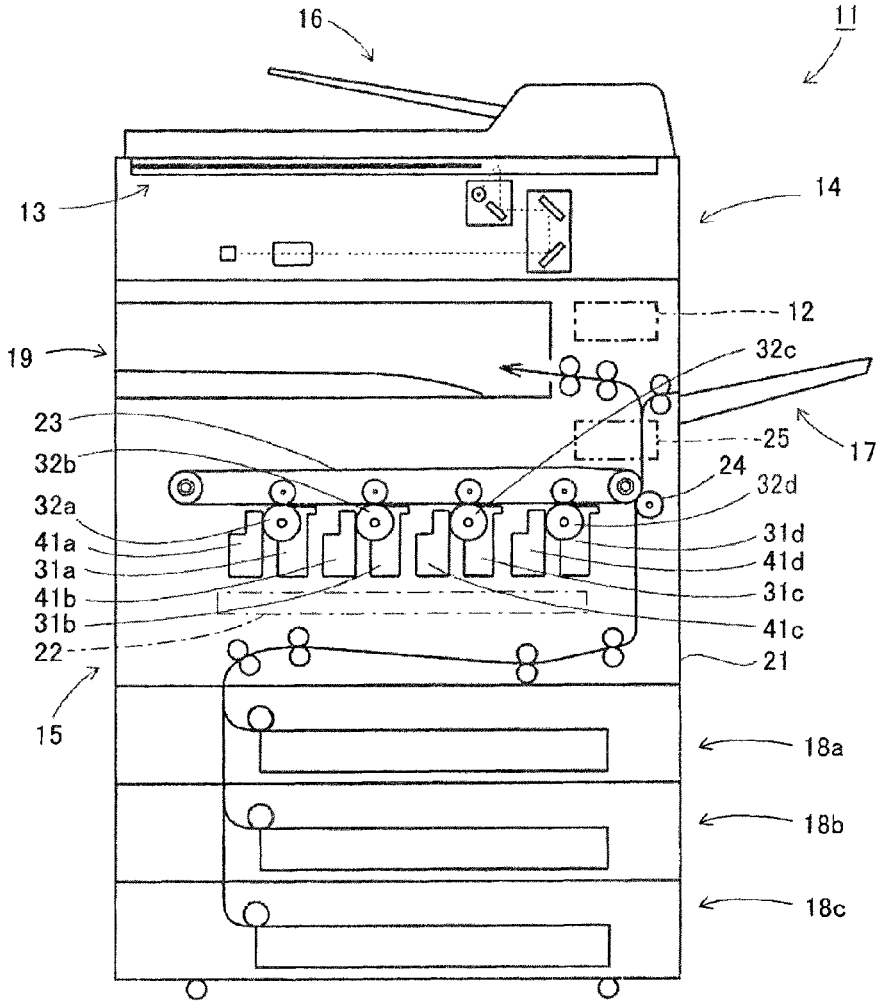
FIG. 1 illustrates a multifunctional peripheral to which an image forming apparatus according to an embodiment of the present disclosure is applied.

An embodiment of the present disclosure will be described hereinafter. FIG. 1 illustrates a multifunctional peripheral to which an image forming apparatus according to the embodiment of the present disclosure is applied.

As illustrated in FIG. 1, a multifunctional peripheral 11 is related to image processing and has a plurality of functions such as a copy function, a printer function, and a facsimile function. The multifunctional peripheral 11 includes a controller 12, an operation part 13, an image reading part 14, an image forming part 15, an auto document feeder (ADF) 16, a manual feed tray 17, three paper cassettes 18*a*, 18*b*, and 18*c*, a discharge part 19, and a body 21.

The controller 12 including a CPU controls the entire multifunctional peripheral 11. In FIG. 1, the controller 12 is schematically indicated by a chain line. The operation part 13 including a touch panel displays information from the multifunctional peripheral 11 and enables a user to input conditions for image formation, such as the number of copies and gradation, and instructions for turning on or off of a power supply. The image reading part 14 reads an image of a document placed on the ADF 16 serving as a document conveying device or a placing table. The image forming part 15 forms an image on a sheet set on the manual feed tray 17 or the paper cassettes 18*a*, 18*b*, and 18*c* and conveyed, based on image data read out by the image reading part 14 or image data transmitted to the multifunctional peripheral 11 via a network (not shown). The sheet on which the image has been formed by the image forming part 15 is discharged to the discharge part 19. Members constituting the image forming part 15 are attached to the body 21 mainly constituting a housing. An unillustrated front cover is attached to the front of the multifunctional peripheral 11.

The configuration of the image forming part 15 included in the multifunctional peripheral 11 will be described in more detail. The image forming part 15 includes a laser scanner unit (LSU) 22, a transfer belt 23 serving as an intermediate transfer body, and a secondary transfer roller 24. The LSU 22 is schematically indicated by a chain line. The multifunctional peripheral 11 includes the image forming part 15 of a so-called four tandem type.

The image forming part 15 corresponds to four colors of yellow, magenta, cyan, and black, and includes four photoreceptor units 31*a*, 31*b*, 31*c*, and 31*d* including photoreceptors 32*a*, 32*b*, 32*c*, and 32*d*, respectively, and four developing units 41*a*, 41*b*, 41*c*, and 41*d*.

The LSU 22 exposes the four photoreceptors 32*a* to 32*d* to light based on image data read out by the image reading part 14 and received image data. Based on color components of light used for the exposure, electrostatic latent images are formed on the photoreceptors 32*a* to 32*d*. Toners corresponding to the four colors are supplied from the developing units 41*a* to 41*d* onto the electrostatic latent images formed on the photoreceptors 32*a* to 32*d* respectively, so that toner images are formed on the photoreceptors 32*a* to 32*d*. The toner images formed on the photoreceptors 32*a* to 32*d* are primarily transferred onto the transfer belt 23. The toner images primarily transferred onto the transfer belt 23 is secondarily transferred onto a sheet by the secondary transfer roller 24, fixed on the sheet by the fixing part 25, and is discharged to the discharge part 19. In FIG. 1, the fixing part 25 is schematically indicated by a chain double-dashed line.

Figure 2:
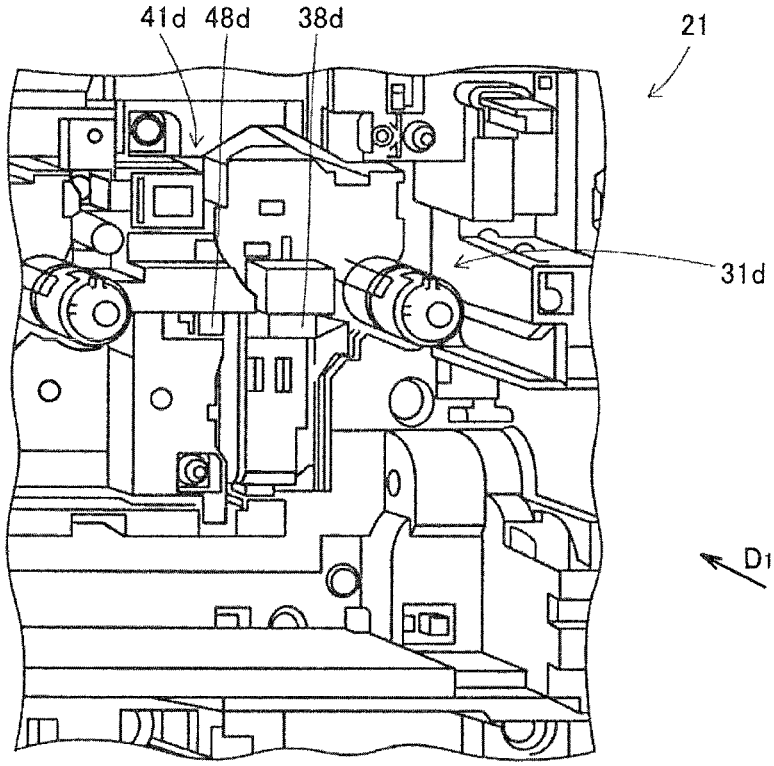
FIG. 2 is a perspective view illustrating configurations of a black photoreceptor unit and a black developing unit attached to a body of the multifunctional peripheral.
Figure 3:
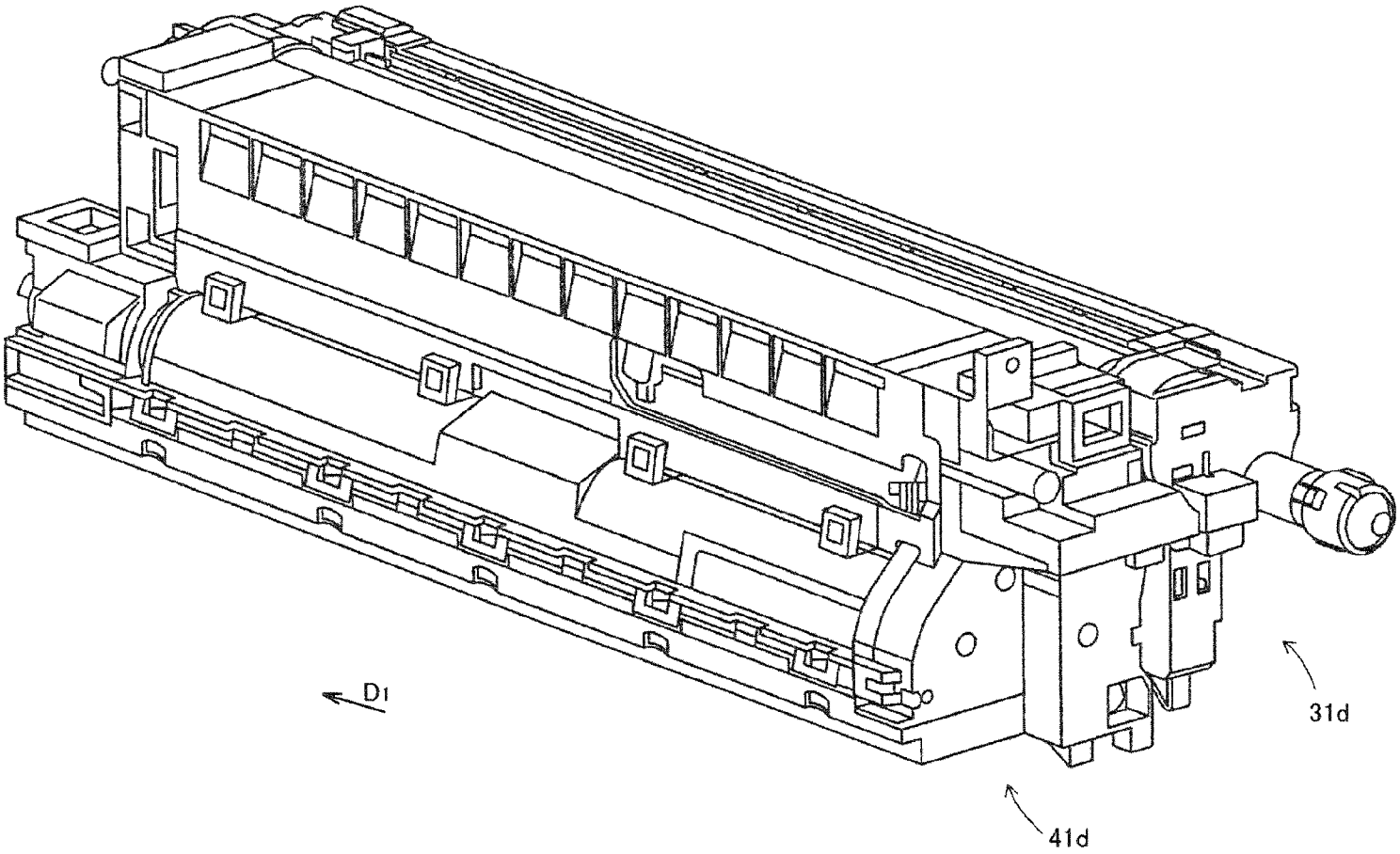
FIG. 3 is a perspective view illustrating a state in which the developing unit is attached to the photoreceptor unit.
Figure 4:
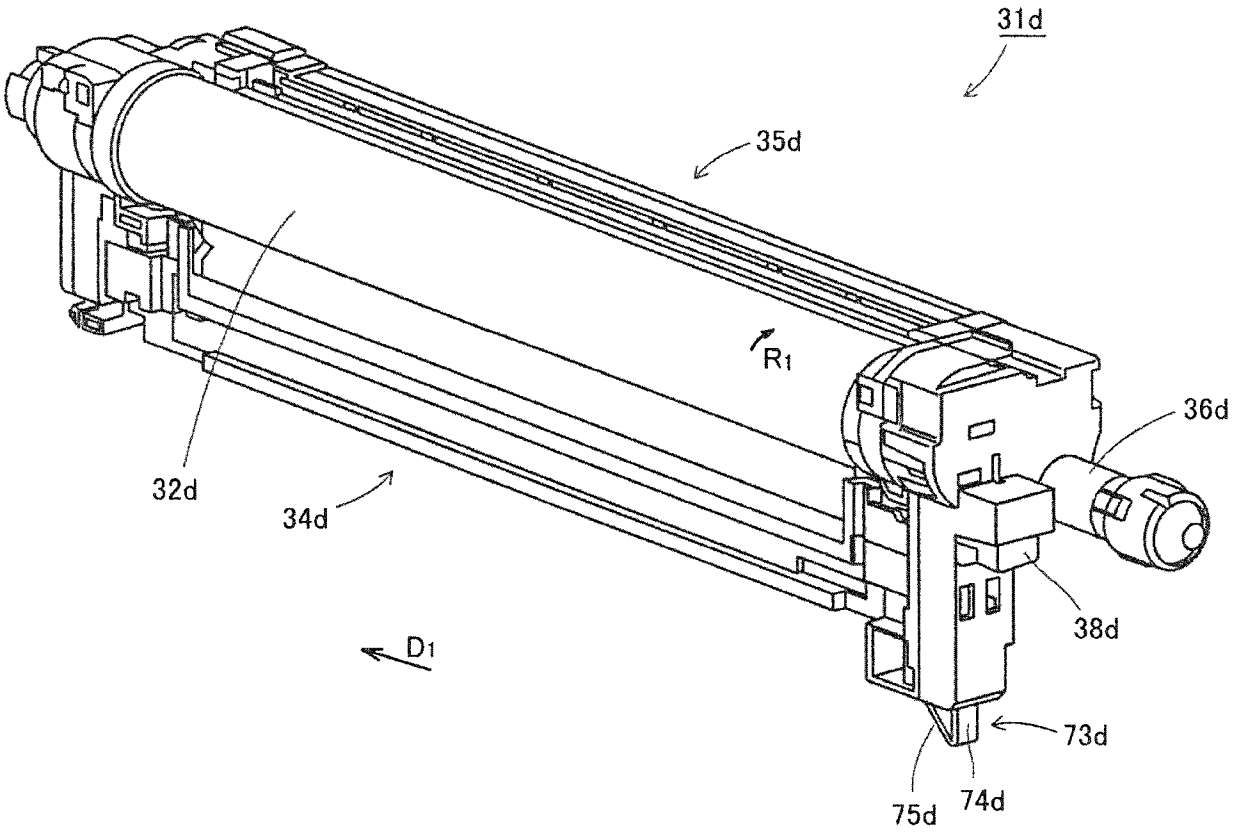
FIG. 4 is a perspective view illustrating the photoreceptor unit.
Figure 5:
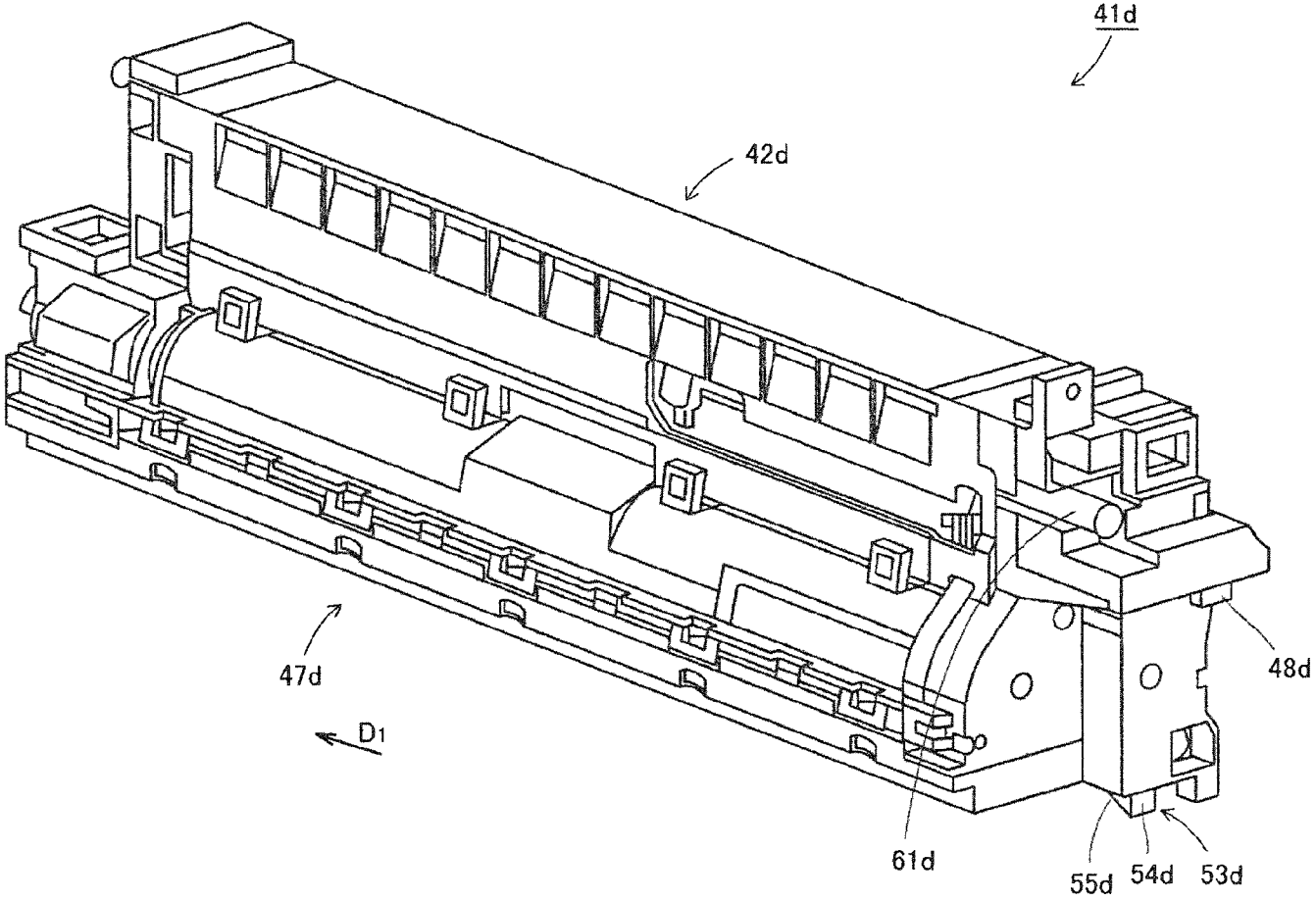
FIG. 5 is a perspective view illustrating the developing unit.
Figure 6:
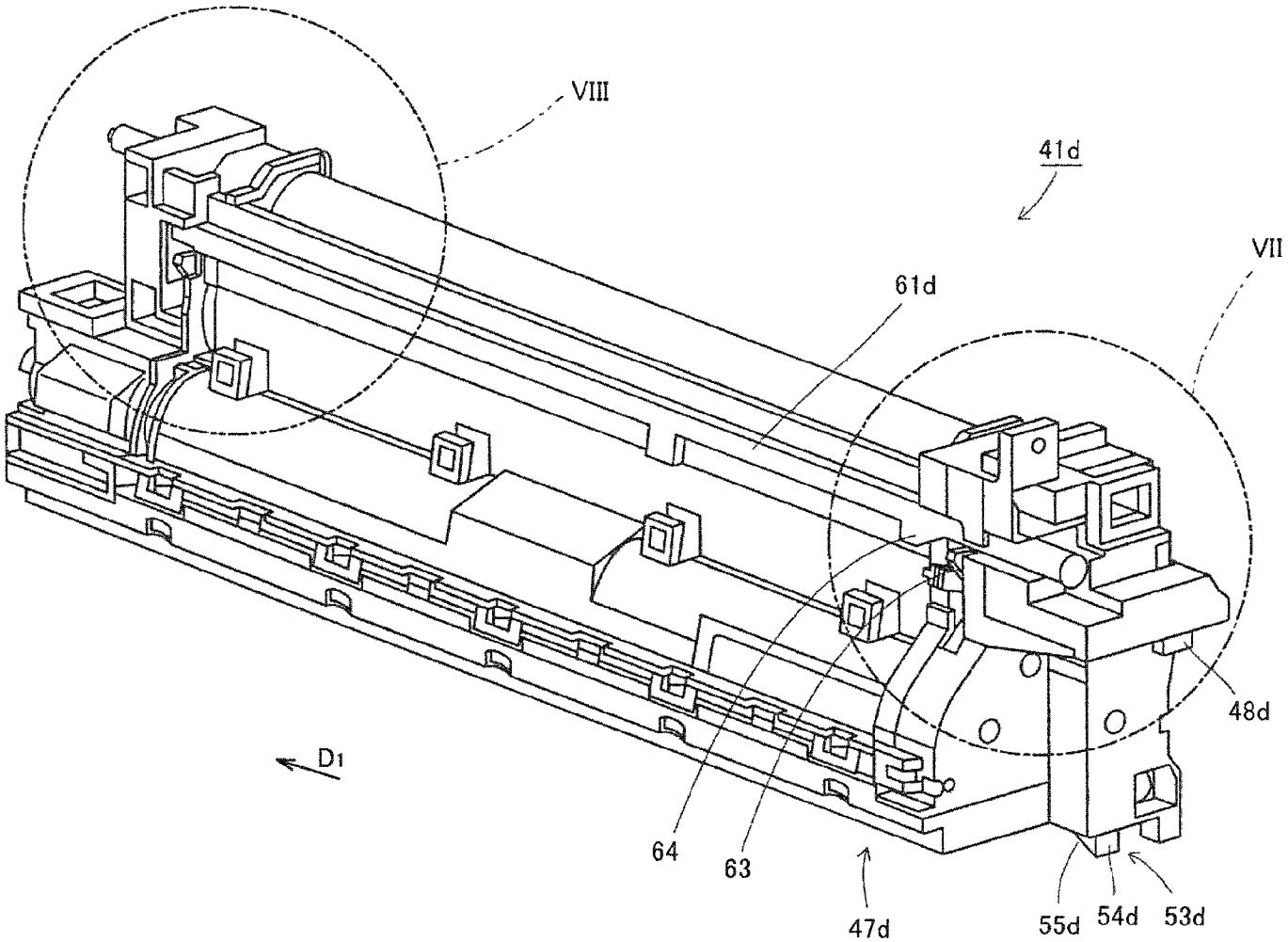
FIG. 6 is a perspective view illustrating the developing unit from which a top cover is removed.
Figure 7:
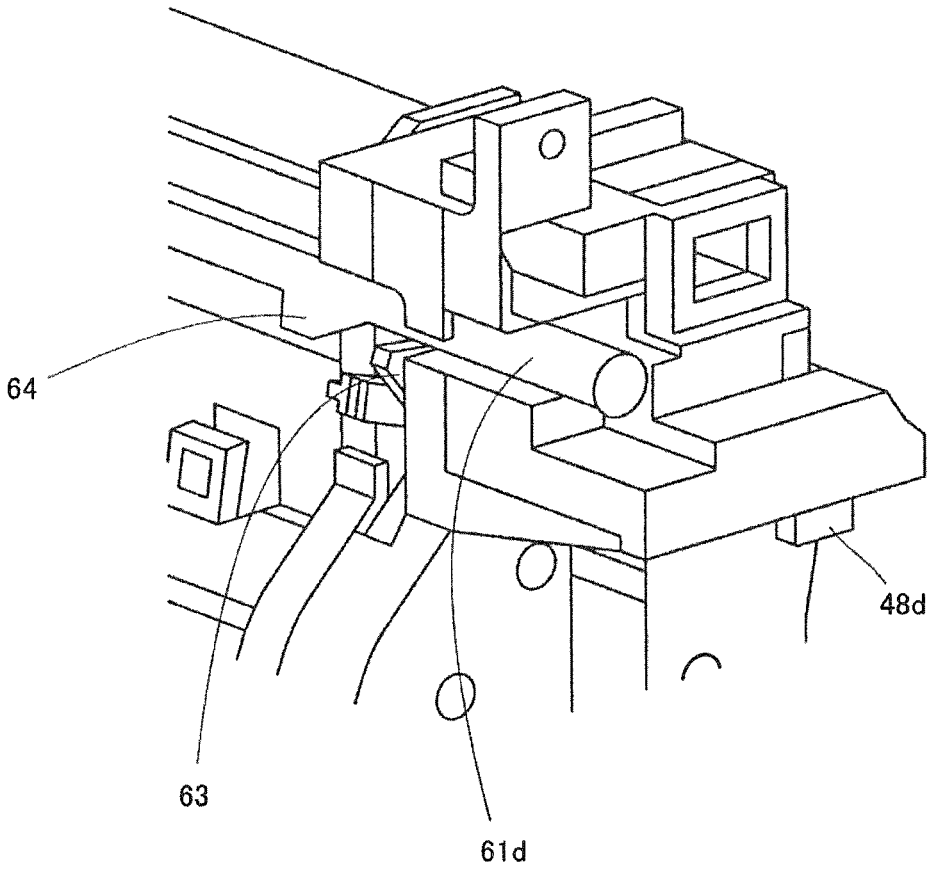
FIG. 7 is an enlarged view of a portion of the developing unit indicated by VII in FIG. 6.
Figure 8:
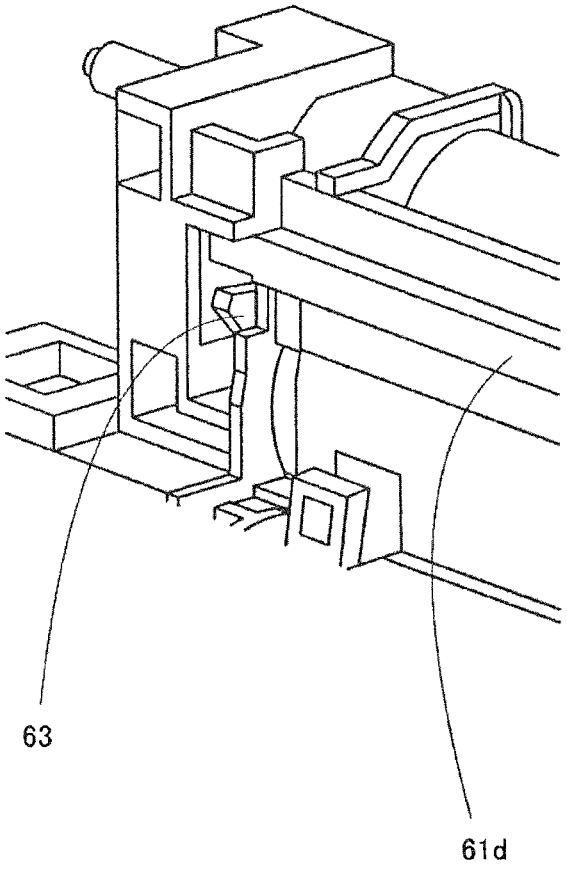
FIG. 8 is an enlarged view of a portion of the developing unit indicated by VIII in FIG. 6.

Specific configuration of the black photoreceptor unit 31*d* and the black developing unit 41*d* included in the image forming part 15 will now be described. FIG. 2 is a perspective view illustrating configurations of the black photoreceptor unit 31*d* and the black developing unit 41*d* attached to the body 21 of the multifunctional peripheral 11. FIG. 3 is a perspective view illustrating a state in which the developing unit 41*d* is attached to the photoreceptor unit 31*d*. FIG. 4 is a perspective view illustrating the photoreceptor unit 31*d*. FIG. 5 is a perspective view illustrating the developing unit 41*d*. FIG. 6 illustrates a state in which a top cover 42*d* described later is removed from the developing unit 41*d* illustrated in FIG. 5. FIG. 7 is an enlarged view of a portion indicated by VII in FIG. 6. FIG. 8 is an enlarged view of a portion indicated by VIII in FIG. 6.

Figure 9:
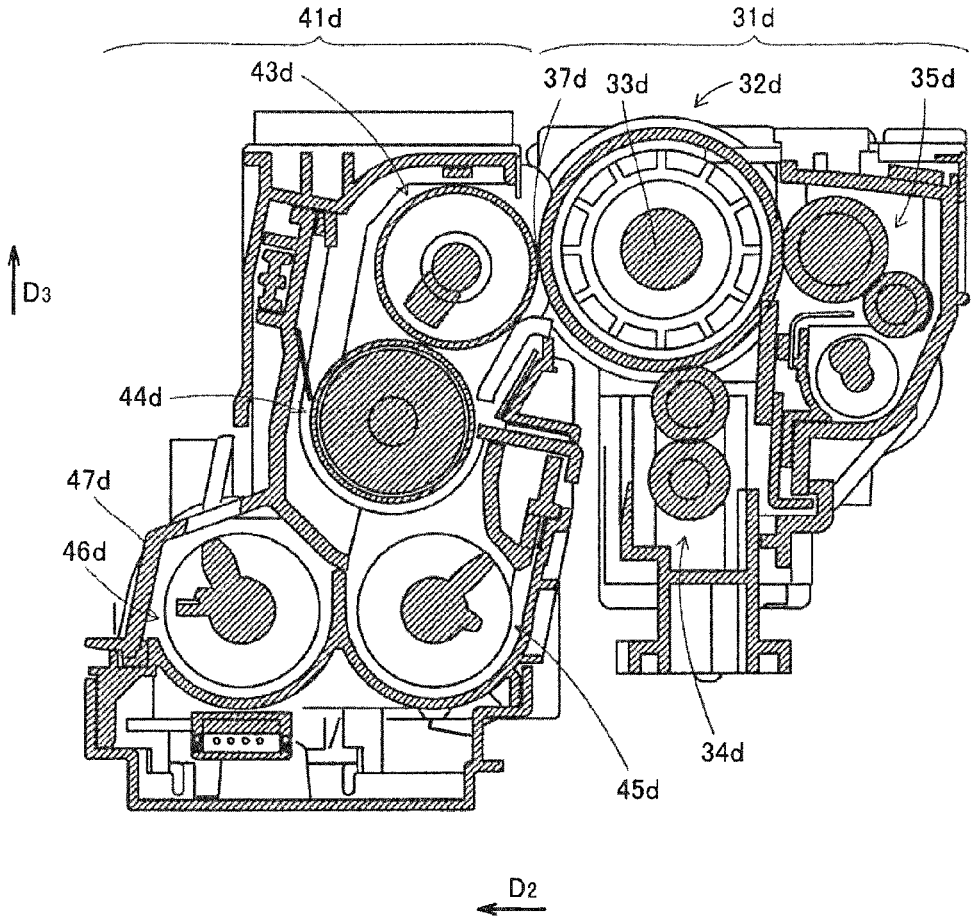
FIG. 9 is a cross sectional view of the developing unit and the photoreceptor unit and illustrates a state in which a photoreceptor and a developing sleeve are in contact with each other.
Figure 10:
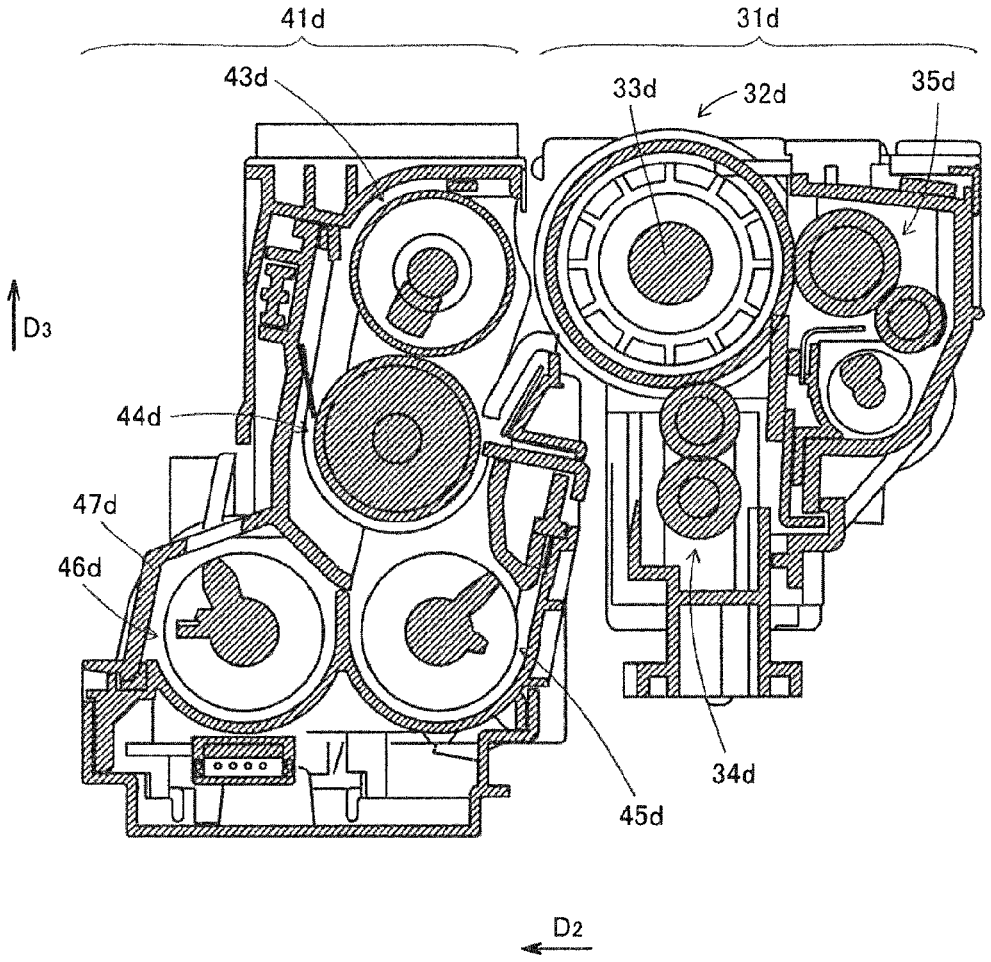
FIG. 10 is a cross sectional view of the developing unit and the photoreceptor unit and illustrates a state in which the developing sleeve is separated from the photoreceptor.

FIGS. 9 and 10 are cross sectional views in which the developing unit 41*d* is attached to the photoreceptor unit 31*d*. Each of FIGS. 9 and 10 illustrates a cross section taken along a plane perpendicular to a rotation axis 33*d* of the photoreceptor 32*d*. FIG. 9 illustrates a state in which the photoreceptor 32*d* and a developing sleeve 43*d* described later are closely disposed. FIG. 10 illustrates a state in which the photoreceptor 32*d* and the developing sleeve 43*d* are separated from each other. For ease of understanding, the same pattern of hatching is used for members in the drawings. Configurations of the yellow photoreceptor unit 31*a* and the yellow developing unit 41*a*, configurations of the magenta photoreceptor unit 31*b* and the magenta developing unit 41*b*, and configurations of the cyan photoreceptor unit 31*c* and the cyan developing unit 41*c* are similar to those of the black photoreceptor unit 31*d* and the black developing unit 41*d*, and thus, description thereof will not be repeated.

As illustrated in FIGS. 1 to 10, the photoreceptor unit 31*d* includes the photoreceptor 32*d* on which an electrostatic latent image is formed, a charging part 34*d*, and a cleaning part 35*d* (see particularly FIGS. 9 and 10). The photoreceptor 32*d* is in the shape of a circular tube, and can rotate about the rotation axis 33*d* in a direction indicated by an arrow R1 in FIG. 4. The charging part 34*d* applies a voltage necessary for forming an electrostatic latent image to the photoreceptor 32*d*. The charging part 34*d* is disposed below the photoreceptor 32*d*. The cleaning part 35*d* removes toner remaining on the photoreceptor 32*d* and electric charge. The cleaning part 35*d* is disposed at a side of the photoreceptor 32*d*. The cleaning part 35*d* includes a cylindrical toner discharge part 36*d* projecting toward the front of the photoreceptor unit 31*d* in order to discharge toner subjected to the cleaning.

The developing unit 41*d* includes the top cover 42*d*, the developing sleeve 43*d*, a magnetic roller 44*d*, a first stirring roller 45*d*, a second stirring roller 46*d*, a developer container 47*d* housing a developer (not shown). The top cover 42*d* is attached to the top of the developing unit 41*d*, and is detachably mounted on the developing unit 41*d*. The developing sleeve 43*d* is also called a developing roller. The magnetic roller 44*d* is also called a mag roller or a magnet roller.

The developing sleeve 43*d* is movable to a first position near the photoreceptor 32*d* and a second position separated from the photoreceptor 32*d*. The state illustrated in FIG. 9 is a state in which the developing sleeve 43*d* is at the first position. The state illustrated in FIG. 10 is a state in which the developing sleeve 43*d* is at the second position. The developing sleeve 43*d* can supply toner onto the surface of the photoreceptor 32*d* at the first position. While the developing sleeve 43*d* is at the first position, a toner layer formed on the surface of the developing sleeve 43*d* is very thin, and thus, the developing sleeve 43*d* and the photoreceptor 32*d* are almost in contact with each other at a closest location 37*d*. When the photoreceptor unit 31*d* or the developing unit 41*d* is detached from the body 21, the developing sleeve 43*d* is set at the second position.

In the magnetic roller 44*d*, N poles and S poles are alternately formed in a circumferential direction. The magnetic roller 44*d* holds a two-component developer on the surface thereof. The magnetic roller 44*d* supplies toner from the two-component developer held on the surface thereof to the developing sleeve 43*d*. A thin layer of toner supplied from the magnetic roller 44*d* is formed on the surface of the developing sleeve 43*d*.

The developer container 47*d* is configured in such a manner that the developing sleeve 43*d*, the magnetic roller 44*d*, and the first and second stirring rollers 45*d* and 46*d* are housed inside the developer container 47*d*. In the developer container 47*d*, the first and second stirring rollers 45*d* and 46*d* supply the developer to the magnetic roller 44*d* while stirring the developer. Toner consumed in development is supplied to the developer container 47*d* at any time. The developing sleeve 43*d*, the magnetic roller 44*d*, and the rotation axes of the first and second stirring rollers 45*d* and 46*d* are in parallel with the rotation axis 33*d* of the photoreceptor 32*d*.

The photoreceptor unit 31*d* and the developing unit 41*d* are attached to the body 21 of the image forming part 15. Specifically, the photoreceptor unit 31*d* and the developing unit 41*d* are inserted in a direction indicated by an arrow $D_1$ in FIG. 2 and attached to the body 21. On the other hand, the photoreceptor unit 31*d* and the developing unit 41*d* are drawn in the direction opposite to the direction indicated by the arrow $D_1$ in FIG. 2 and detached from the body 21.

Here, the photoreceptor unit 31*d* and the developing unit 41*d* are individually detachable from and attachable to the body 21. That is, the photoreceptor unit 31*d* can be detached from the body 21 without detaching the developing unit 41*d* from the body 21. The developing unit 41*d* can also be detached from the body 21 without detaching the photoreceptor unit 31*d* from the body 21.

In detaching the photoreceptor unit 31*d* or the developing unit 41*d*, the developing sleeve 43*d* is moved from the first position to the second position. The developing unit 41*d* includes a first attaching/detaching lever 48*d* that moves the developing sleeve 43*d* from the first position to the second position. The photoreceptor unit 31*d* includes a second attaching/detaching lever 38*d* that moves the developing sleeve 43*d* from the first position to the second position. The developing sleeve 43*d* is moved to the second position by lifting the first or second attaching/detaching lever 48*d* or 38*d*.

Figure 11:
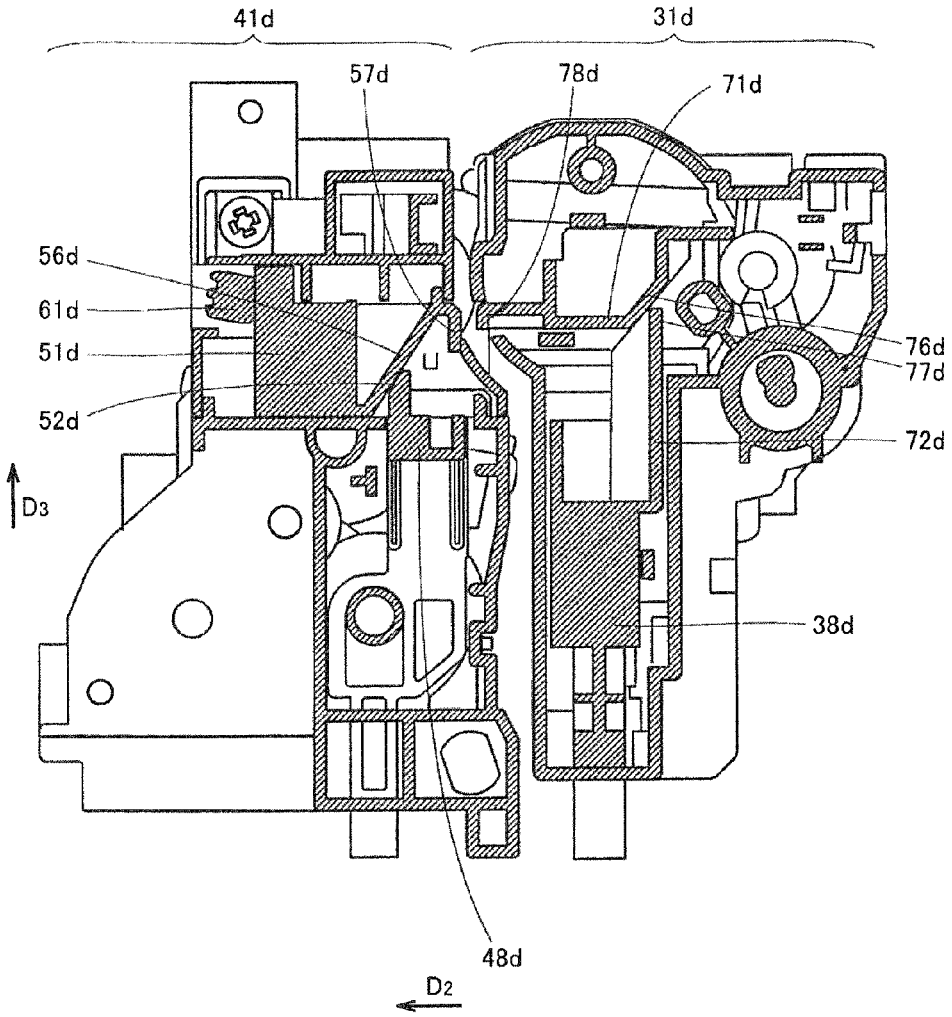
FIG. 11 is a cross sectional view illustrating a state in which the developing unit is attached to the photoreceptor unit.
Figure 12:
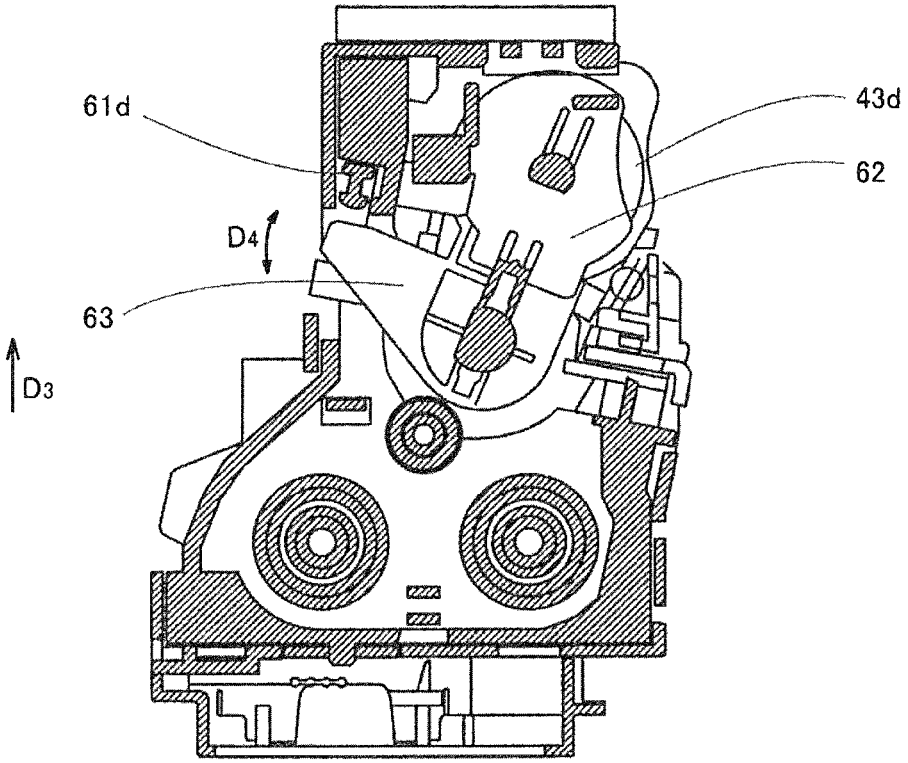
FIG. 12 is a cross sectional view illustrating a state in which the developing unit is attached to the photoreceptor unit.
Figure 13:
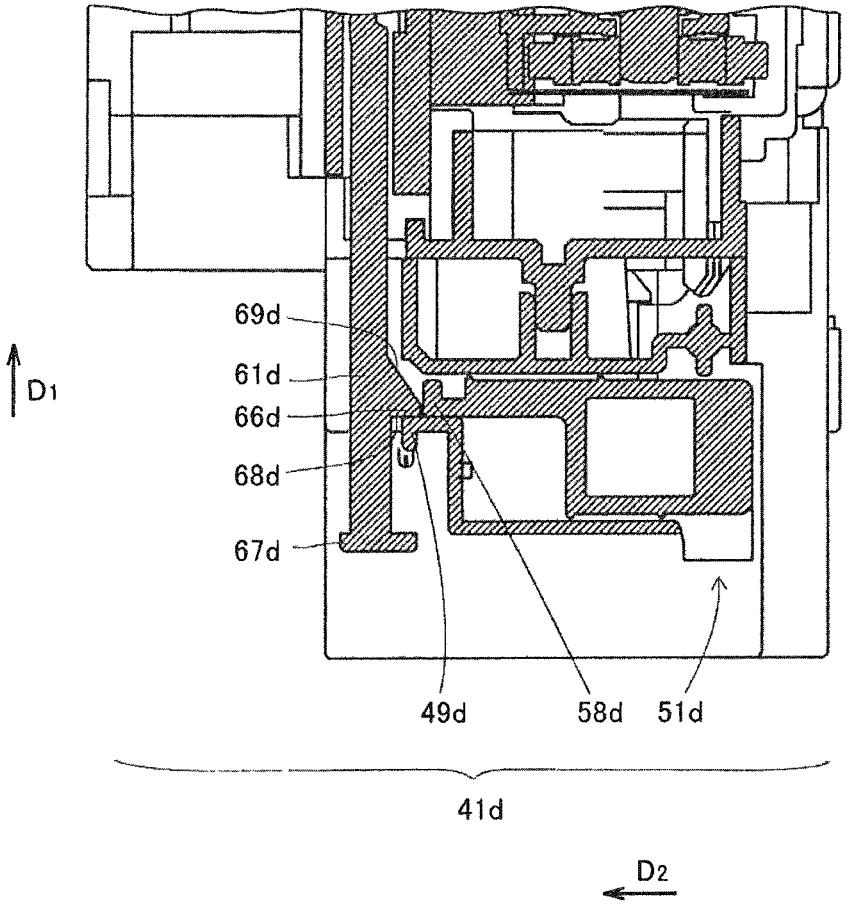
FIG. 13 is a cross sectional view of the developing unit taken along a plane extending along a rotation axis of the photoreceptor.
Figure 14:
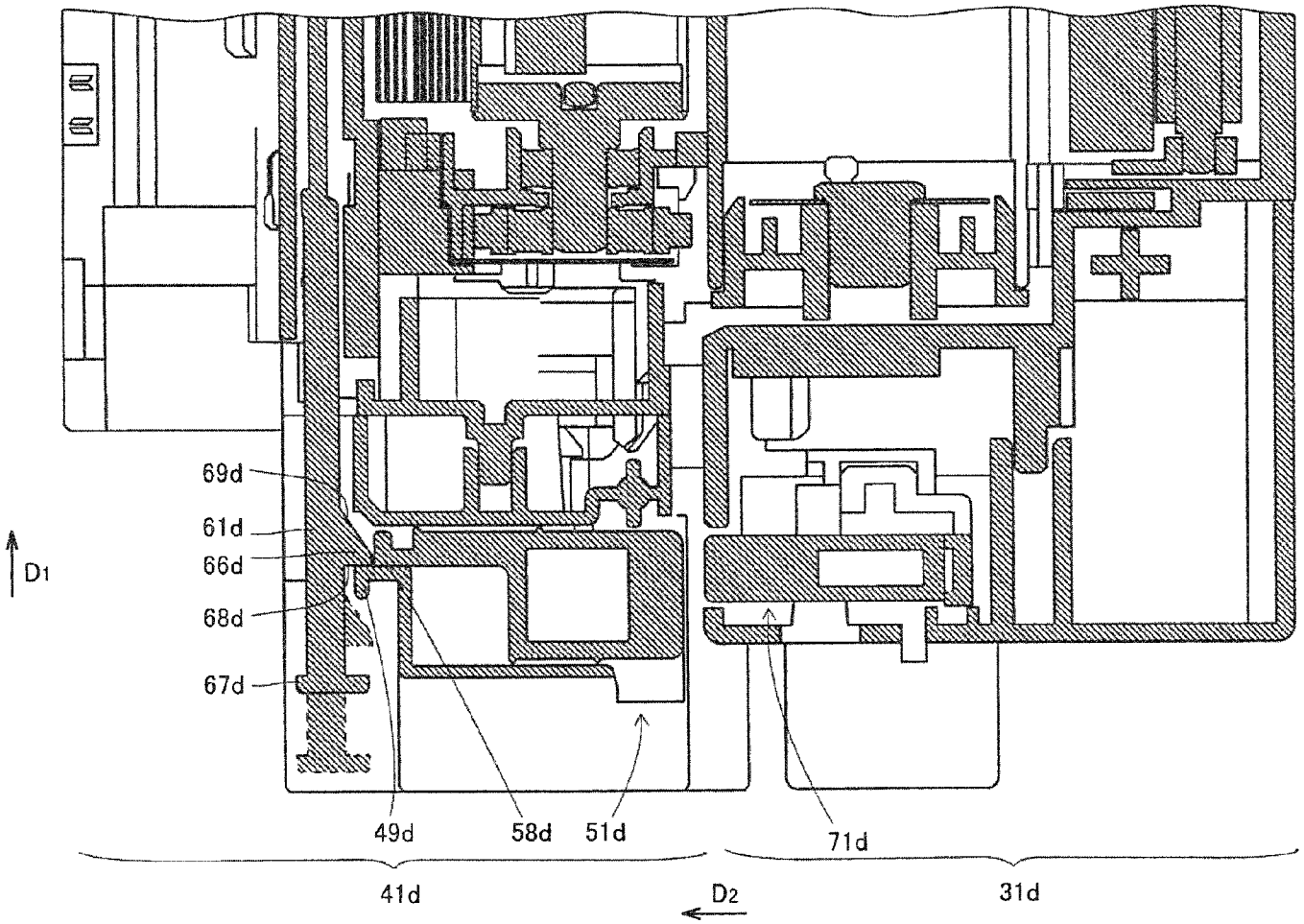
FIG. 14 is a cross sectional view of the developing unit and the photoreceptor unit taken along a plane extending along the rotation axis of the photoreceptor.

Specifically, the following configuration is employed. FIGS. 11 and 12 are cross sectional views illustrating a state in which the developing unit 41*d* is attached to the photoreceptor unit 31*d*. Each of FIGS. 11 and 12 illustrates a cross section taken along a plane perpendicular to the rotation axis 33*d* of the photoreceptor 32*d*. The cross section illustrated in FIG. 11 is different from those illustrated in FIGS. 9 and 10 in that the cross section illustrated in FIG. 11 does not include the developing sleeve 43*d* and the photoreceptor 32*d* but includes, for example, a first releasing member 51*d* described later. The cross section illustrated in FIG. 12 is different from those illustrated in FIGS. 9 and 10 in that the cross section illustrated in FIG. 12 does not include the developing sleeve 43*d* and the photoreceptor 32*d* but includes, for example, a rotation axis of the developing sleeve 43*d* described later. FIG. 13 is a cross sectional view illustrating the developing unit 41*d*. FIG. 14 is a cross sectional view illustrating the developing unit 41*d* and the photoreceptor unit 31*d*. Each of FIGS. 13 and 14 illustrates a cross section taken along a plane extending along the rotation axis 33*d* of the photoreceptor 32*d*.

With reference to FIGS. 1 to 14, especially FIGS. 11 to 14, a mechanism for moving the developing unit 41*d* between the first position and the second position will be described. The developing unit 41*d* includes the first attaching/detaching lever 48*d*, the first releasing member 51*d*, and a developing sleeve releasing lever 61*d*. The first attaching/detaching lever 48*d* is moved in up-and-down directions, that is, in a direction indicated by an arrow $D_3$ and an opposite direction thereof. The first attaching/detaching lever 48*d* is exposed at the front of the body 21 while the unillustrated front cover is open. That is, after opening the front cover, a user can operate the first attaching/detaching lever 48*d* to move the first attaching/detaching lever 48*d* in up-and-down directions.

A first attaching/detaching lever tilted part 52*d* is provided at an upper end of the first attaching/detaching lever 48*d* (see FIG. 11). A first hook 53*d* is integrally provided at a lower end of the first attaching/detaching lever 48*d* (see FIGS. 5 and 6). A front portion of the first hook 53*d* is constituted by a vertically extending plane 54*d*, and a plane of the first hook 53*d* extending from a lower end to the rear thereof is constituted by a tilted plane 55*d* that is tilted from the vertical direction. When the first attaching/detaching lever 48*d* moves downward, the first hook 53*d* projects from a lower face of the developing unit 41*d*.

In mounting the developing unit 41*d* on the body 21, the developing unit 41*d* is inserted along the tilted plane 55*d*, and accordingly, the first hook 53*d* moves upward. Thus, in pushing the developing unit 41*d* from the front to the rear of the body 21, movement of the developing unit 41*d* is not restricted by engagement of the first hook 53*d* with the body 21. When the developing unit 41*d* is pushed to a predetermined location in the body 21, contact between the first hook 53*d* and a part of the housing constituting the body 21 is canceled so that the first attaching/detaching lever 48*d* moves downward by its weight or a biasing force and the first hook 53*d* projects downward. In this state, the plane 54*d* at the front of the first hook 53*d* is engaged with a part of the housing of the body 21 so that forward movement of the developing unit 41*d* is restricted.

The first releasing member 51*d* is moved laterally, that is, a direction indicated by an arrow $D_2$ and an opposite direction thereof. With reference especially to FIG. 11, a first releasing member tilted part 56*d* that is tilted is provided at the right side of the first releasing member 51*d*. The first releasing member tilted part 56*d* is in contact with the first attaching/detaching lever tilted part 52*d* provided to the first attaching/detaching lever 48*d*. That is, the first releasing member 51*d* is in contact with the first attaching/detaching lever 48*d*. Since the first attaching/detaching lever tilted part 52*d* and the first releasing member tilted part 56*d* that are tilted in the same direction are in contact with each other, the first releasing member 51*d* can be moved laterally in cooperation with up-and-down movement of the first attaching/detaching lever 48*d* whose lateral movement is restricted. A first releasing member extension part 57*d* is provided at a right end of the first releasing member 51*d*, that is, at the right of the first releasing member tilted part 56*d*, and extends in up-and-down directions.

The developing sleeve releasing lever 61*d* is made of a resin material. The developing sleeve releasing lever 61*d* is a long slender rod-shaped member extending along the rotation axis of the developing sleeve 43*d*, that is, the direction indicated by the arrow $D_1$. The developing sleeve releasing lever 61*d* is flexible and can bend in a direction orthogonal to the direction indicated by the arrow $D_1$. The developing sleeve releasing lever 61*d* is supported by the developing unit 41*d* to be movable in the direction indicated by the arrow $D_1$ and the opposite direction thereof, and is biased to the direction opposite to the direction indicated by the arrow $D_1$, that is, biased from the rear to the front, by an unillustrated biasing member. The developing sleeve releasing lever 61*d* is integrally formed with a projection 64 that can be in contact with a cam part 63 of a bearing member 62 that rotatably holds the developing sleeve 43*d* (see FIG. 7). The projection 64 extends and is tilted in such a manner that the diameter of the developing sleeve releasing lever 61*d* increases from the front to the rear. Movement of the developing sleeve releasing lever 61*d* in the direction indicated by the arrow $D_1$ and the opposite direction thereof changes the contact state between the cam part 63 and the projection 64 and causes the bearing member 62 to shift in a direction indicated by an arrow $D_4$ in FIG. 12 so that the developing sleeve 43*d* is moved to a location between the first position and the second position.

The developing sleeve releasing lever 61*d* includes a pawl part 66*d* and a knob part 67*d* that are integrally formed near a front end of the developing sleeve releasing lever 61*d* (see FIGS. 13 and 14). The pawl part 66*d* is a wedge-shaped projection constituted by a plane 68*d* extending straight in the direction indicated by the arrow $D_2$ and a tilted plane 69*d* that is tilted and extends from the right end of the plane 68*d* in such a manner that the diameter of the pawl part 66*d* gradually decreases in the direction indicated by the arrow $D_1$. The knob part 67*d* projects toward the front of the developing unit 41*d*, and has a front edge that can be pushed rearward by a finger.

As illustrated in FIG. 14, the plane 68*d* of the pawl part 66*d* is hooked by a part of a housing 49*d* of the developing unit 41*d* so that movement of the developing sleeve releasing lever 61*d* forward against a biasing force of the biasing member is restricted. In this state, a left end 58*d* of the first releasing member 51*d* is in contact with the pawl part 66*d* of the developing sleeve releasing lever 61*d*.

Figure 15:
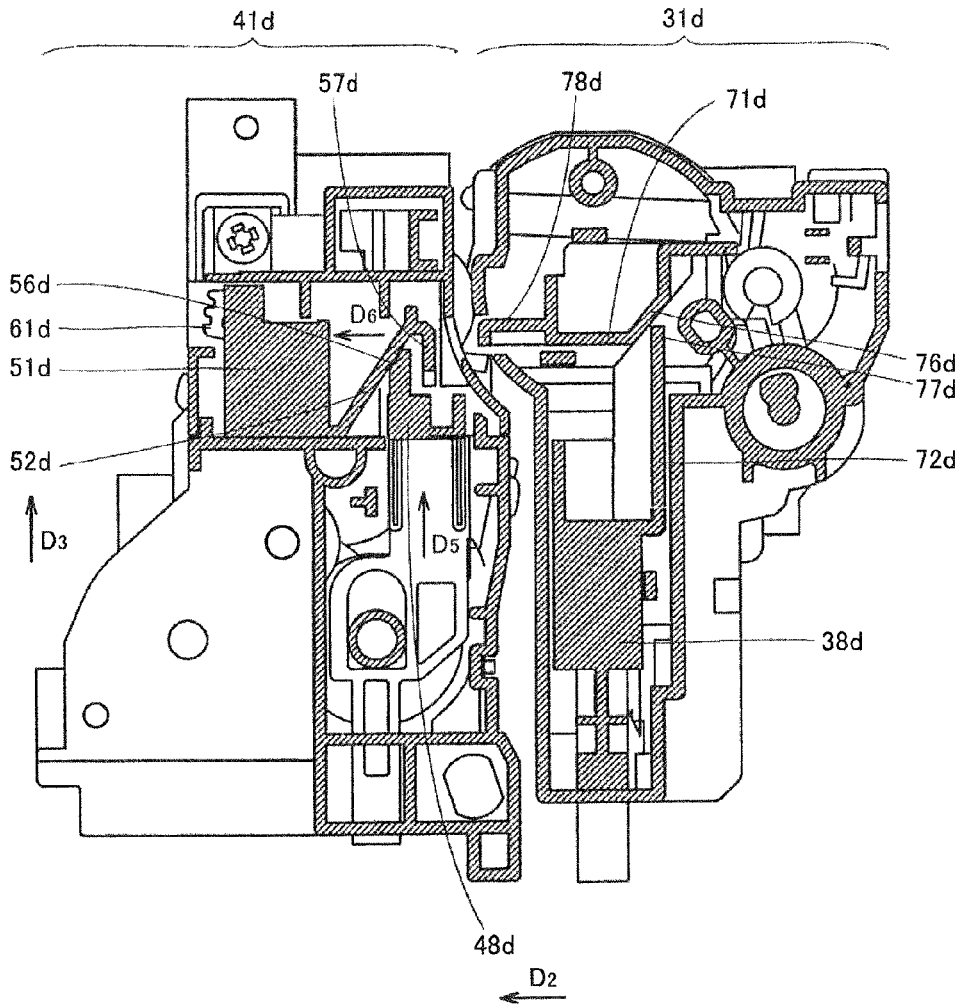
FIG. 15 is a cross sectional view of the developing unit and the photoreceptor unit in a case where the developing sleeve is moved from a first position to a second position by using a first attaching/detaching lever.

A method for moving the developing sleeve 43*d* from the first position to the second position by using the first attaching/detaching lever 48*d* will now be described. FIG. 15 is a cross sectional view illustrating the developing unit 41*d* and the photoreceptor unit 31*d* in this state. The cross section illustrated in FIG. 15 corresponds to the cross section illustrated in FIG. 11.

With also reference to FIG. 15, when the first attaching/detaching lever 48*d* is lifted in a direction indicated by an arrow $D_5$ in FIG. 15, since the first attaching/detaching lever tilted part 52*d* and the first releasing member tilted part 56*d* are in contact with each other, the first releasing member 51*d* moves to the left, that is, in the direction indicated by the arrow $D_2$, in cooperation with the lifting. For easy understanding, the arrow $D_6$ in FIG. 15 indicates the same direction as that indicated by the arrow $D_2$. When the pawl part 66*d* of the developing sleeve releasing lever 61*d* is pushed to the left (see FIG. 14) by the movement of the first releasing member 51*d* in the direction indicated by the arrow $D_2$ (arrow $D_6$), engagement of the developing sleeve releasing lever 61*d* with a part of the housing 49*d* of the developing unit 41*d* is canceled. This canceling causes the developing sleeve releasing lever 61*d* to move forward, that is, in the direction opposite to the direction indicated by the arrow $D_1$, by a biasing force of an unillustrated biasing member. The location to which the developing sleeve releasing lever 61*d* is moved is indicated by a broken line in FIG. 14. In cooperation with this movement, the contact state between the cam part 63 and the projection 64 is changed so that the developing sleeve 43*d* is moved to the second position. With upward movement of the first attaching/detaching lever 48*d*, the first hook 53*d* moves upward so that engagement of the first hook 53*d* with the part of the housing of the body 21 is canceled, and thus, the developing unit 41*d* can move forward.

As described above, after the developing sleeve 43*d* has been moved from the first position to the second position, the developing unit 41*d* can be detached from the body 21. In this manner, it is possible to detach the developing unit 41*d* from the body 21, while ensuring avoidance of interference between the developing sleeve 43*d* and the photoreceptor unit 31*d*. In this case, the developing unit 41*d* can be detached from the body 21 without detachment of the photoreceptor unit 31*d*. As a result, working efficiency can be enhanced.

A configuration for detaching the photoreceptor unit 31*d* will now be described. The photoreceptor unit 31*d* includes a second attaching/detaching lever 38*d* and a second releasing member 71*d* (see FIG. 11). The second attaching/detaching lever 38*d* can be moved in up-and-down directions, that is, in the direction indicated by the arrow $D_3$ and the opposite direction thereof. In a manner similar to the first attaching/detaching lever 48*d*, the second attaching/detaching lever 38*d* is exposed at the front of the body 21 while the unillustrated front cover is open. That is, after opening the front cover, a user can operate the second attaching/detaching lever 38*d* to move the second attaching/detaching lever 38*d* in up-and-down directions.

A second attaching/detaching lever extension part 72*d* is provided in an upper portion of the second attaching/detaching lever 38*d* and extends in up-and-down directions. A second hook 73*d* is integrally formed at a lower end of the second attaching/detaching lever 38*d* (see FIG. 4). The second hook 73*d* has a shape similar to that of the first hook 53*d*. A front portion of the second hook 73*d* is constituted by a vertically extending plane 74*d*. A plane of the second hook 73*d* extending from a lower end to the rear thereof is constituted by a tilted plane 75*d* that is tilted from the vertical direction.

When the second attaching/detaching lever 38*d* moves downward, the second hook 73*d* projects from a lower face of the photoreceptor unit 31*d*. In mounting the photoreceptor unit 31*d* on the body 21, the rear tilted plane 75*d* of the second hook 73*d* comes into contact with a part of the housing of the body 21 so that the second attaching/detaching lever 38*d* moves upward. Thus, rearward movement of the photoreceptor unit 31*d* is not restricted.

When the photoreceptor unit 31*d* is pushed to a predetermined location in the body 21, contact between the second hook 73*d* and a part of the housing constituting the body 21 is canceled so that the second attaching/detaching lever 38*d* moves downward by its weight or a biasing force and the second hook 73*d* projects downward. In this state, the plane 74*d* at the front of the second hook 73*d* is engaged with a part of the housing of the body 21 so that forward movement of the photoreceptor unit 31*d* is restricted.

The second releasing member 71*d* can be moved laterally, that is, in the direction indicated by the arrow $D_2$ and the opposite direction thereof. A second releasing member tilted part 76*d* that is tilted from the up-and-down directions is provided at the right of the second releasing member 71*d*. The second releasing member tilted part 76*d* is in contact with an upper end 77*d* of the second attaching/detaching lever extension part 72*d*. That is, the second releasing member 71*d* is in contact with the second attaching/detaching lever 38*d*. In cooperation with the up-and-down movement of the second attaching/detaching lever 38*d*, the second releasing member 71*d* can be moved laterally. That is, when the second attaching/detaching lever 38*d* whose lateral movement is restricted is moved upward, the second releasing member 71*d* is pushed along the slope of the second releasing member tilted part 76*d* that is in contact with the end 77*d* and moves to the left. The second releasing member extension part 78*d* located at the left end of the second releasing member 71*d* and extending in up-and-down directions is configured to come into contact with the first releasing member extension part 57*d* located at the right end of the first releasing member 51*d*.

Figure 16:
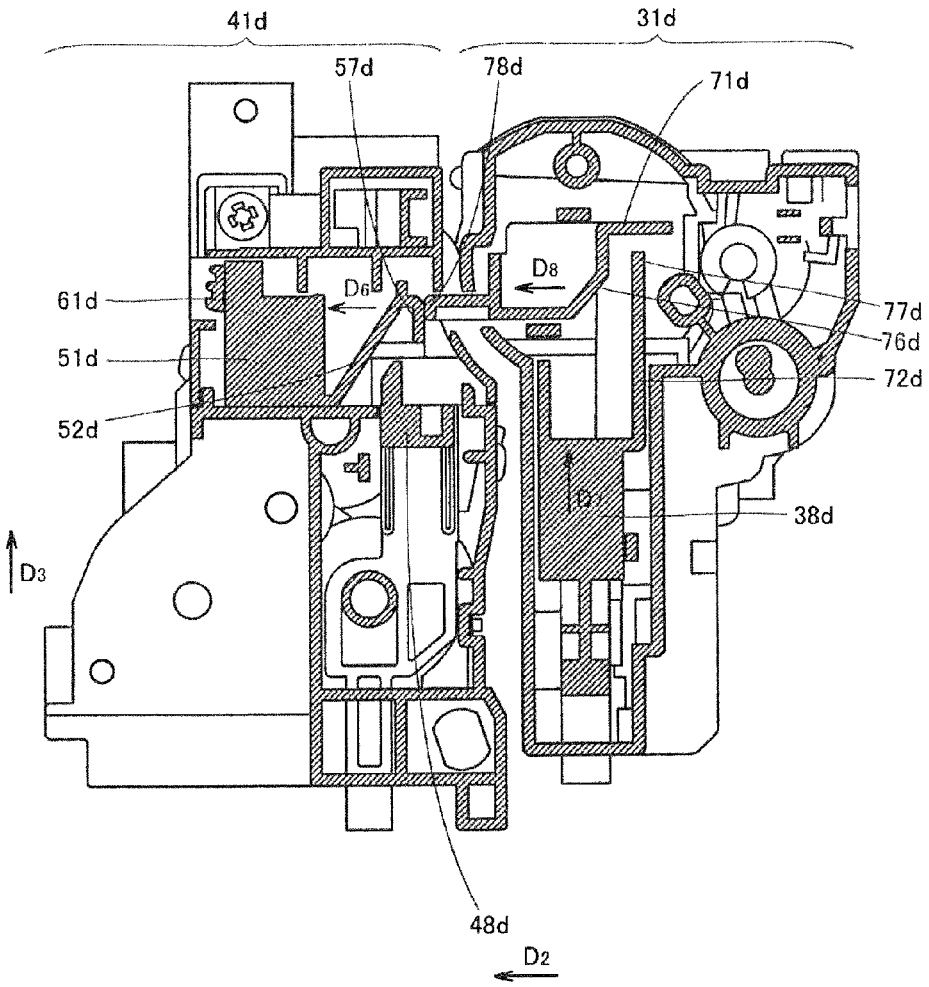
FIG. 16 is a cross sectional view of the developing unit and the photoreceptor unit in a case where the developing sleeve is moved from the first position to the second position by using a second attaching/detaching lever.

A method for moving the developing sleeve 43*d* from the first position to the second position by using the second attaching/detaching lever 38*d* will now be described. FIG. 16 is a cross sectional view illustrating the developing unit 41*d* and the photoreceptor unit 31*d* in this state. The cross section illustrated in FIG. 16 corresponds to the cross section illustrated in FIG. 11.

With also reference to FIG. 16, when the second attaching/detaching lever 38*d* is lifted in a direction indicated by an arrow $D_7$ in FIG. 16, since the end 77*d* of the second attaching/detaching lever extension part 72*d* and the second releasing member tilted part 76*d* are in contact with each other, the first releasing member 51*d* moves to the left, that is, moves in the direction indicated by the arrow $D_2$, in cooperation with the lifting. For easy understanding, an arrow $D_8$ in FIG. 16 indicates the same direction as that indicated by the arrow $D_2$. In the state illustrated in FIG. 16, the end 77*d* of the second attaching/detaching lever extension part 72*d* and the second releasing member tilted part 76*d* are not in contact with each other in the cross section of FIG. 16, but are in contact with each other in another cross section. The movement of the second releasing member 71*d* in the direction indicated by the arrow $D_2$ (arrow $D_8$) brings the second releasing member extension part 78*d* at the left end of the second releasing member 71*d* into contact with the first releasing member extension part 57*d* at the right end of the first releasing member 51*d* so that the first releasing member 51*d* is pushed in the same direction as that indicated by the arrow $D_2$ (arrow $D_6$). When the first releasing member 51*d* is pushed to the left, in a manner similar to that in lifting of the first attaching/detaching lever 48*d*, the pawl part 66*d* of the developing sleeve releasing lever 61*d* is pushed to the left so that engagement of the developing sleeve releasing lever 61*d* with a part of the housing 49*d* of the developing unit 41*d* is canceled. This canceling causes the developing sleeve releasing lever 61*d* to move forward, that is, in the direction opposite to the direction indicated by the arrow $D_1$, by a biasing force of an unillustrated biasing member. In cooperation with this movement, the contact state between the cam part 63 and the projection 64 is changed so that the developing sleeve 43*d* is moved to the second position. With upward movement of the second attaching/detaching lever 38*d*, the second hook 73*d* moves upward so that engagement of the second hook 73*d* with a part of the housing of the body 21 is canceled, and thus, the photoreceptor unit 31*d* can move forward.

After the developing sleeve 43*d* has been moved from the first position to the second position, the photoreceptor unit 31*d* can be detached from the body 21. In this manner, it is possible to detach the photoreceptor unit 31*d* from the body 21, while ensuring avoidance of interference between the photoreceptor unit 31*d* and the developing sleeve 43*d*. In this case, the photoreceptor unit 31*d* can be detached from the body 21 without detachment of the developing unit 41*d*. As a result, working efficiency can be enhanced.

As described above, in detaching the photoreceptor unit 31*d* from the body 21, the foregoing configuration enables detachment of only the photoreceptor unit 31*d* from the body 21 without detachment of the developing unit 41*d* from the body 21. Thus, complexity in work for attaching and detaching the developing unit 41*d* can be avoided and, in addition, the probability of scattering of toner occurring in detaching or attaching the developing unit 41*d* can be reduced, for example. In this case, since the developing sleeve 43*d* has been moved to the second position, interference between the photoreceptor 32*d* and the developing sleeve 43*d* can be avoided. Thus, the multifunctional peripheral 11 configured as described above can enhance working efficiency.

In addition, in the case of mounting one of the photoreceptor unit 31*d* or the developing unit 41*d* on the body 21, even if the other of the photoreceptor unit 31*d* or the developing unit 41*d* has been mounted on the body 21, since the developing sleeve 43*d* is at the second position, interference between the photoreceptor 32*d* and the developing sleeve 43*d* can be avoided. In this case, after the photoreceptor unit 31*d* and the developing unit 41*d* have been mounted on the body 21, the knob part 67 of the developing sleeve releasing lever 61*d* at a location indicated by a broken line in FIG. 14 is pushed in the direction indicated by the arrow $D_1$ so that the developing sleeve 43*d* can be moved to the first position relative to the photoreceptor unit 31*d*. When the developing sleeve releasing lever 61*d* is pushed from a location indicated by the broken line, a part of the housing 49*d* of the developing unit 41*d* comes into contact with the pawl part tilted plane 69*d* to be pushed to the right and partially bent by elasticity and the pawl part 66*d* is engaged with a part of the housing 49 of the developing unit 41*d*. In this manner, the developing sleeve 43*d* can be moved from the second position to the first position and held at this location.

In the embodiment described above, the direction of movement from the first position to the second position is perpendicular to the direction along which the rotation axis of the photoreceptor 42*d* extends. However, the present disclosure is not limited to this direction, and the direction of movement from the first position to the second position may be tilted from the direction along which the rotation axis extends, for example.

It should be understood that the embodiment and examples disclosed herein are illustrative and non-restrictive in every respect. The scope of the present disclosure is defined by the terms of the claims, rather than by the foregoing description, and is intended to include any modifications within the scope and meaning equivalent to the terms of the claims.

An image forming apparatus according to the present disclosure is especially useful in the case of requiring enhanced working efficiency.

What is claimed is:

1. An image forming apparatus comprising:

a body;

a photoreceptor unit including a photoreceptor having a surface on which an electrostatic latent image is formed, the photoreceptor unit being detachably mounted on the body; and a developing unit configured to be detachably mounted on the body, including a developing sleeve for supplying a developer to the photoreceptor, and the developing sleeve is movable to a first position at which the developing sleeve is allowed to supply the developer to the photoreceptor and a second position at which the photoreceptor and the developing sleeve are separated from each other to avoid contact between the photoreceptor and the developing sleeve, wherein the developing unit includes a first attaching/detaching lever that moves the developing sleeve from the first position to the second position by lifting the first attaching/detaching lever, the photoreceptor unit includes a second attaching/detaching lever that moves the developing sleeve from the first position to the second position by lifting the second attaching/detaching lever, and the photoreceptor unit and the developing unit move the developing sleeve to the second position by lifting the first attaching/detaching lever or the second attaching/detaching lever so that the photoreceptor unit and the developing unit are individually detached from the body.

2. The image forming apparatus according to claim 1, wherein the developing unit includes a first releasing member that moves the developing sleeve from the first position to the second position, and the photoreceptor unit includes a second releasing member that moves the developing sleeve from the first position to the second position.

3. The image forming apparatus according to claim 2, wherein the first releasing member is in contact with the first attaching/detaching lever, and the second releasing member is in contact with the second attaching/detaching lever.

4. The image forming apparatus according to claim 2, wherein the first releasing member moves the developing sleeve from the first position to the second position or from the second position to the first position in cooperation with up-and-down movement of the first attaching/detaching lever, and the second releasing member moves the developing sleeve from the first position to the second position or from the second position to the first position in cooperation with up-and-down movement of the second attaching/detaching lever.

5. The image forming apparatus according to claim 2, wherein the second releasing member is in contact with the first releasing member, and when the second attaching/detaching lever is lifted, the second releasing member moves the first releasing member in a direction in which the developing sleeve is moved to the second position.

6. The image forming apparatus according to claim 2, wherein the first releasing member is in contact with a developing sleeve releasing lever for moving the developing sleeve.

* * * * *